US006857560B2

(12) United States Patent
Kutner

(10) Patent No.: US 6,857,560 B2
(45) Date of Patent: Feb. 22, 2005

(54) COLLAPSIBLE CONTAINER WITH BOTTOM DISCHARGE

(75) Inventor: Kenneth Kutner, W. Hempstead, NY (US)

(73) Assignee: Container Packaging Corp, Paterson, NJ (US)

( * ) Notice: Subject to any disclaimer, the term of this patent is extended or adjusted under 35 U.S.C. 154(b) by 0 days.

(21) Appl. No.: 10/692,059

(22) Filed: Oct. 24, 2003

(65) Prior Publication Data

US 2004/0129732 A1 Jul. 8, 2004

Related U.S. Application Data

(60) Provisional application No. 60/437,879, filed on Jan. 6, 2003.

(51) Int. Cl.[7] ..... B67D 5/06

(52) U.S. Cl. ..... 229/122.2; 229/125.12; 229/117.28; 222/183; 222/185.1; 222/105

(58) Field of Search ..... 222/183, 185.1, 222/561, 105; 229/122.2, 125, 117.28, 942

(56) References Cited

U.S. PATENT DOCUMENTS

| | | | | | |
|---|---|---|---|---|---|
| 3,499,594 | A | * | 3/1970 | Peene | 229/120.01 |
| 3,606,969 | A | * | 9/1971 | Voytko | 229/122.3 |
| 3,799,409 | A | * | 3/1974 | Goerke | 229/122.2 |
| 4,449,649 | A | * | 5/1984 | Flannigan | 222/561 |

* cited by examiner

*Primary Examiner*—Philippe Derakshani
(74) *Attorney, Agent, or Firm*—Charles E. Temko

(57) ABSTRACT

A fibrous collapsible shipping container for transporting small articles and particulate material and discharging the same under gravity through a bottom wall opening after the horizontal movement of a sliding door. The container may include a liner element to provide increased rigidity where the loaded contents are relatively heavy. In a second embodiment, the container includes a second medially positioned bottom wall and sliding door to provide incremental discharge of the contents, as desired.

3 Claims, 6 Drawing Sheets

COLLAPSIBLE CONTAINER WITH BOTTOM DISCHARGE

RELATED APPLICATION

Reference is made to my provisional application Ser. No. 60/437,879 filed Jan. 6, 2003, now abandoned, to which a claim of priority is made.

BACKGROUND OF THE INVENTION

This invention relates generally to the field of reusable shipping containers of the type disclosed in U.S. Pat. Nos. 4,946,091 and 4,572,408.

Containers of this general type enable the shipping of particulate materials from a source to a point of use, and a discharge of the product through an opening in the lower portion of the side wall. Where the material is relatively heavy, the container is provided with a liner element overlying the inner surfaces of the side walls to prevent bulging or other distortion of the container in loaded condition. When the contents have been discharged, the liner is removed and folded to planar condition, following which the container itself is folded along preexisting fold lines so that both liner and container may be placed in generally planar condition within the peripheral wall of a cover element for return shipment. The bottom wall of the container is usually provided with a so called "slip sheet", or it stands on short blocks to provide space for the entry of forklift equipment to move the container over short distances for purposes of stacking, and the like, and to provide rigidity to the entire structure. In some cases, there is provided an integral pallet made of wood or other rigid material for this purpose.

Such containers may also be used for the shipment of non-particulate products such as small synthetic resinous containers used, for example, to store body deodorants and the like, which are subsequently filled on a production line. Discharge of such products through a side wall, in some cases, is not as convenient for many applications, and particulate leakage from the container during shipment is usually not a problem. However, the containers are usually sufficiently large that emptying the same from the top of the container is not practical.

SUMMARY OF THE INVENTION

Briefly stated, the invention contemplates the provision of an improved container of the type described which is suitable for shipment and subsequent discharge of relatively small light weight articles, such as plastic containers, or particulate materials, which may be supported on a generally horizontal surface for discharge through an opening in a bottom wall thereof. The opening is closed by a sliding door, as contrasted with prior art pivotably mounted flaps to close the opening, such provision eliminating the need for providing a corresponding flap opening in the liner element as in the prior art. Further, the sliding door may be opened to vary the size of the opening, thus controlling the flow of material therethrough. It is also possible to provide an intermediate sliding door, which projects into the interior of the container so that incremental discharge of the contents is possible. When emptied, the container and liner are folded to planar condition for return shipment. Where the bottom wall of the container is of composite construction, including the abovementioned slip sheet, the opening extends through the composite construction. By employing a combination of corrugated materials for the removable cover and the liner member, increased mechanical strength and durability are obtained without significantly increasing the weight of the container or the cost of manufacture.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
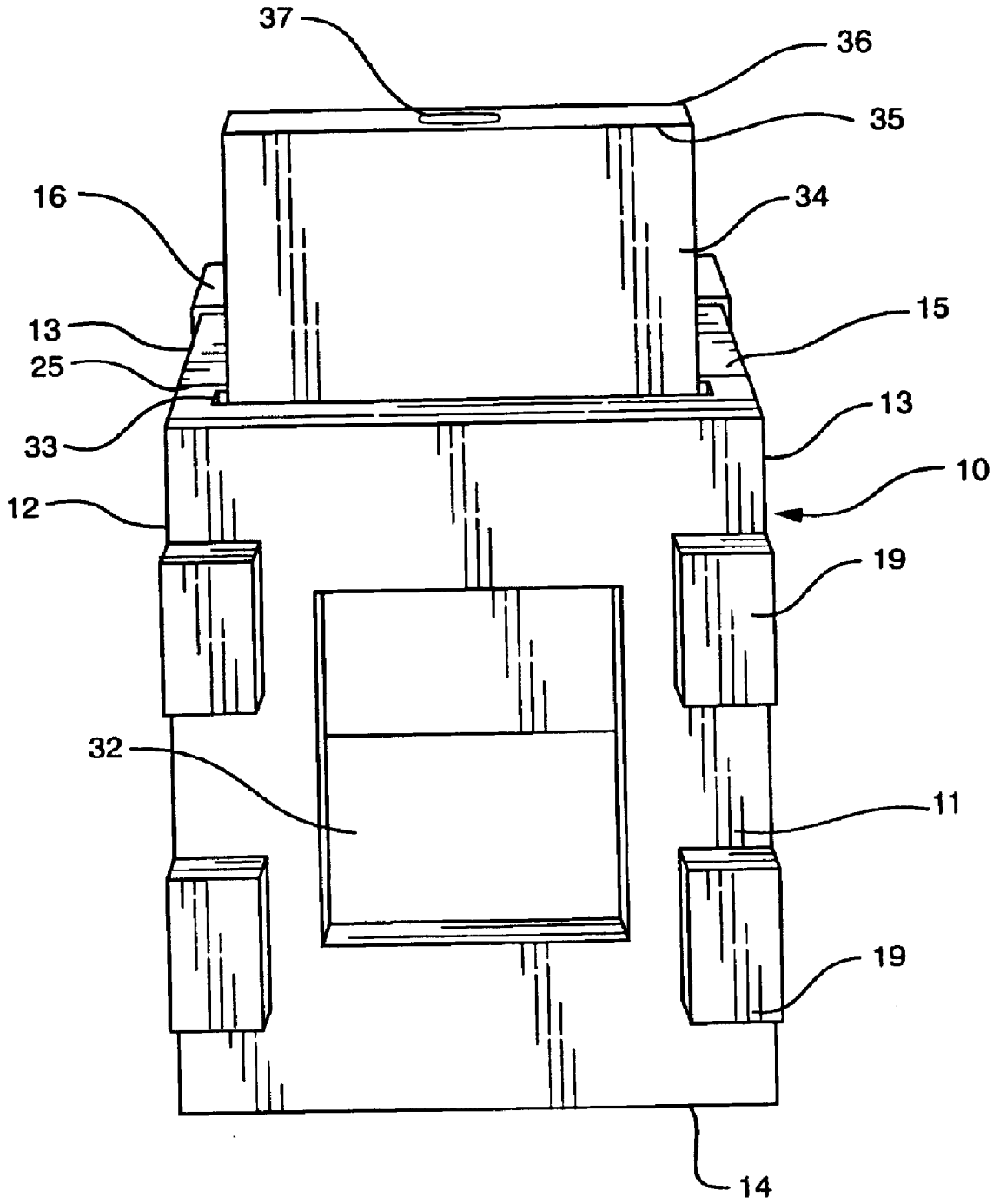
FIG. 1 is a bottom perspective view of a first embodiment of the invention.
Figure 2:
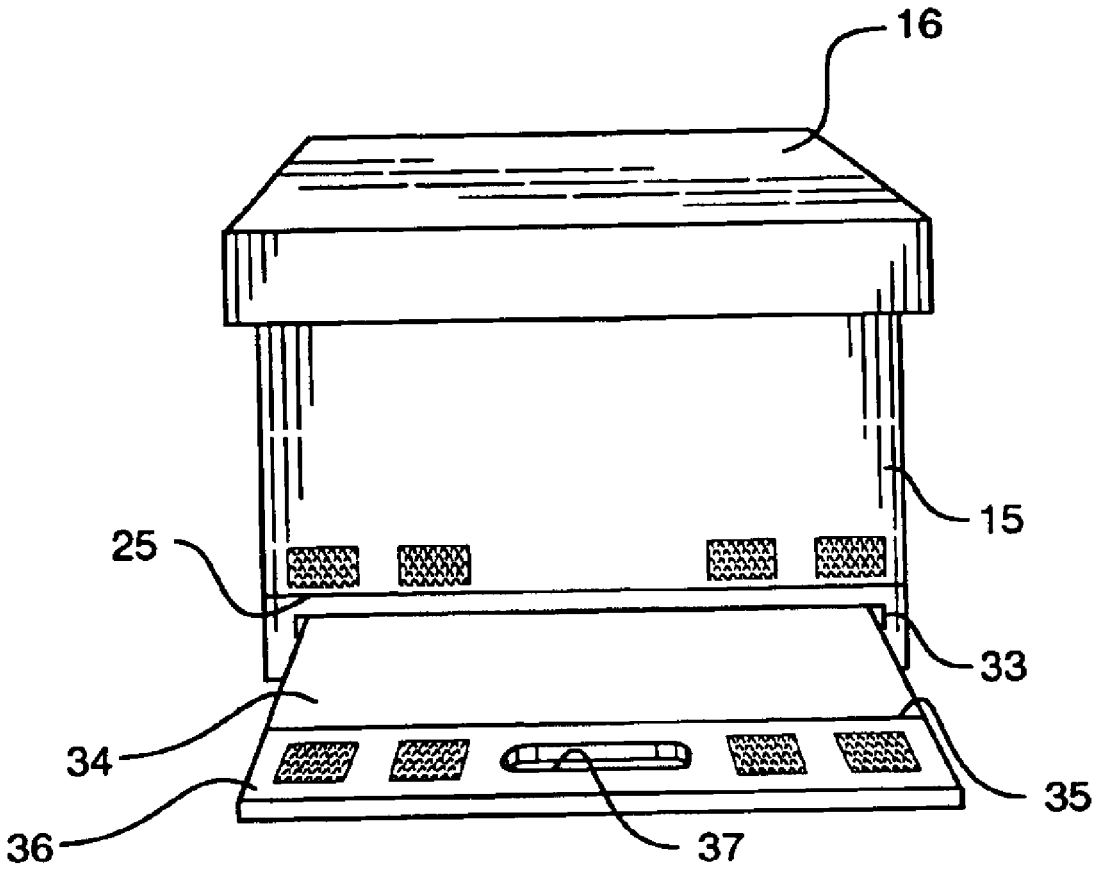
FIG. 2 is a front perspective view thereof showing certain of the component parts in altered relative condition.
Figure 3:
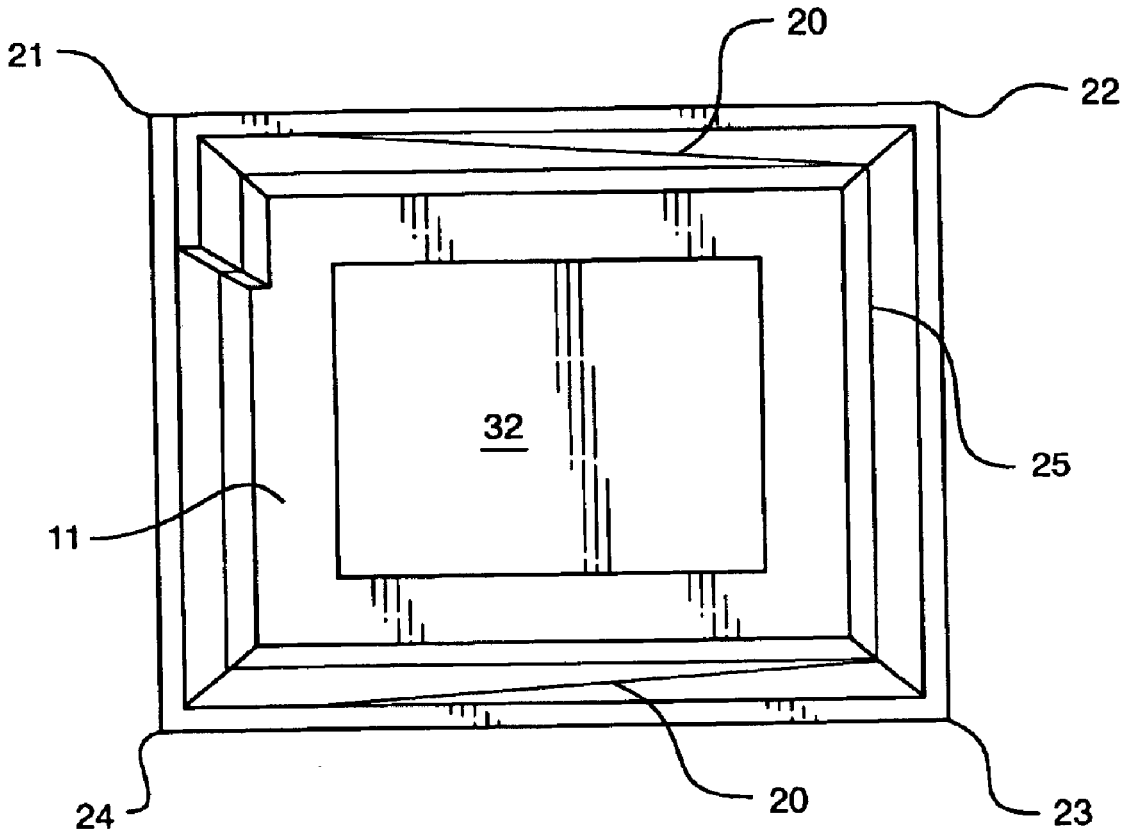
FIG. 3 is a top plan view thereof.
Figure 4:
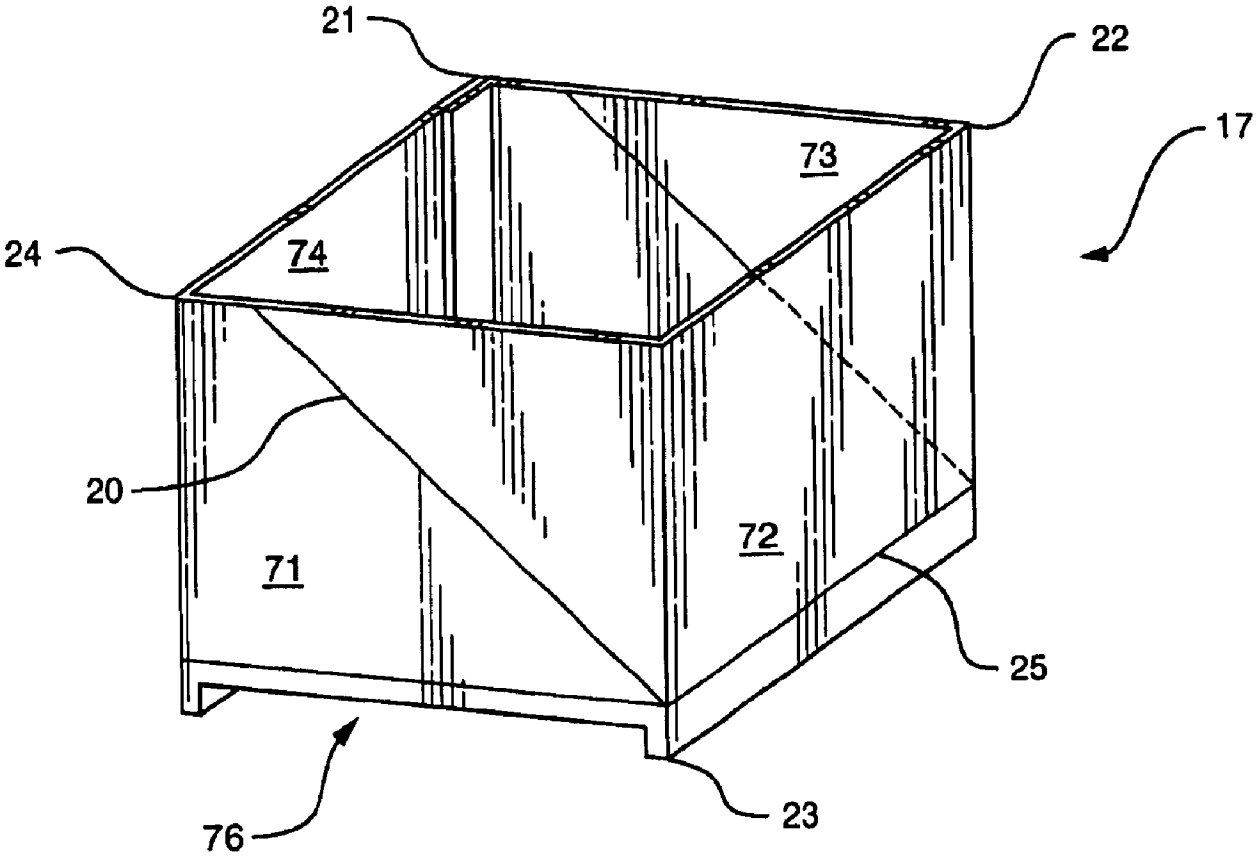
FIG. 4 is a perspective view of a liner element forming part of the first embodiment.
Figure 5:
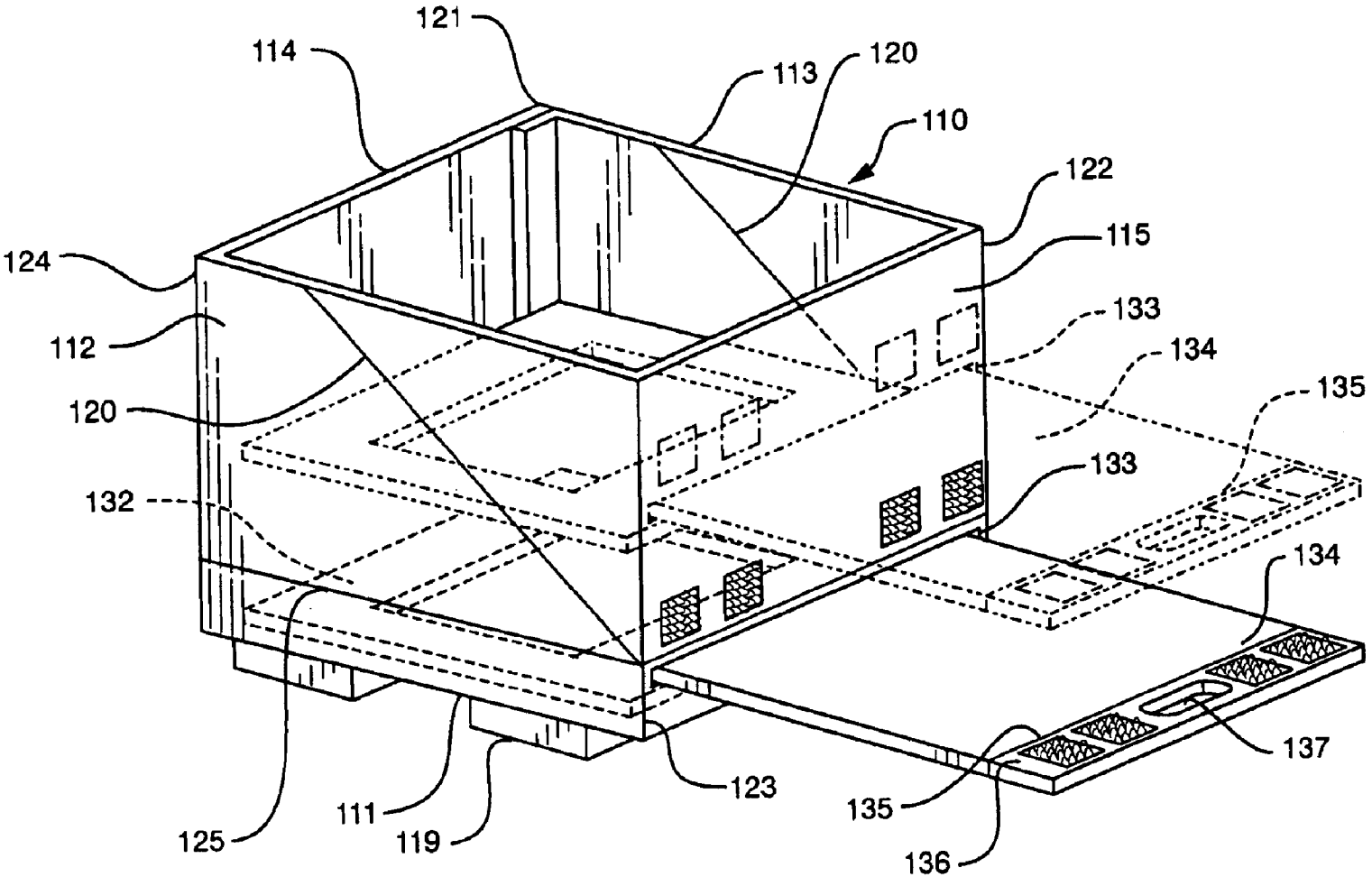
FIG. 5 is a perspective view showing a second embodiment of the invention with certain parts removed for purposes of clarity.

In accordance with the first embodiment of the invention, the device, generally indicated by reference character 10 is in the form of an open top generally rectangular container having the bottom wall 11, side walls 12 and 13, a rear wall 14, and a front wall 15. Overlying the upper opening is a removable cover 16. A liner member 17 is selectively foldable to planar condition and overlies the inner surfaces of the side, rear and front walls in known manner. The bottom wall 11 may be provided with a plurality of short legs 19, to permit engagement of a container by a forklift or other similar device, as is known in the art.

The side walls 12 and 13 are provided with diagonally positioned fold lines 20 to facilitate collapse of the container when empty. The walls 11 to 15 are interconnected at vertical corner edges 21, 22, 23 and 24, which may be reinforced, if desired. A continuous fold line 25 is positioned approximately five inches from the upper surface of the bottom wall to provide a space for accomodating the folded liner member beneath the folded sides of the container prior to engagement with the cover 16.

The front wall 15 is provided with a horizontally extending slot 33 to permit insertion of a sliding rectangular panel 34 which in fully engaged position overlies the opening 32 in the bottom wall. The panel 34 includes a transversely extending fold line 35 forming an outwardly extending handle 36 having an opening 37 for manual engagement. The handle is normally maintained in position parallel to the outer surface of the side wall using hook and pile interconnecting means, as is known in the art.

I have found that the mechanical strength of the disclosed embodiments can be significantly increased by using combinations of materials which have been employed in other applications without substantially increasing the weight of the container or the cost of production.

In place of standard materials employed in the art, I have found that the cover element 16 while of normal dimensions is preferably formed from double ply corrugated material in which the flutes of each ply are of differently sized spacings and are manufactured using waterproof adhesives, to obtain increased impact strength and weatherability without significant addition to weight.

By contrast, the liner member 17 which must be foldable is preferably formed from triple wall corrugated material with relatively larger flutes, so that fold and score lines may be conveniently formed and flexed without weakening the material. While not essential, waterproof adhesives may also be used.

Where an optional slip sheet (not shown) is used, this is most conveniently formed by laminating plural sheets of compacted solid fiber material, approximately 9/10 of an inch thick, with the bottom surface being coated with synthetic resinous material. The bottom lips are preferably highly colored to assist locating the edges thereof for convenient engagement.

As an alternative, wood block construction is sometimes employed. A standard size of 4×4×8 inches of fir or similar wood is convenient, and a varying number of such blocks may be used at even intervals, depending upon the weight of the loaded container.

The liner member 17 includes foldably interconnected panels 71,72,73 and 74, with the panel 71 forming a slot 76 adapted to overlie the slot 33 in the front panel.

Use of the disclosed embodiment is generally similar to that disclosed in the above mentioned prior art patents. However, the container is normally supported on a horizontally oriented rather than an angularly oriented supporting rack (not shown) and when the sliding panel is partially or fully withdrawn, the contents of the container will flow through the opening 32 in the bottom wall to fall upon a conveying means (not shown) depending upon the nature of the contents. The flow of material may be interrupted by again fully inserting the panel to close the through opening. Normally, the container will empty the entire contents under the action of gravity, although, in the case of particulate or other light weight material, this may be assisted by the use of a compressed air nozzle or the like.

Turning now to the second embodiment of the invention, generally indicated by reference character 110, parts corresponding to those of the first embodiment had been indicated by similar reference characters with the additional prefix "1".

Figure 6:
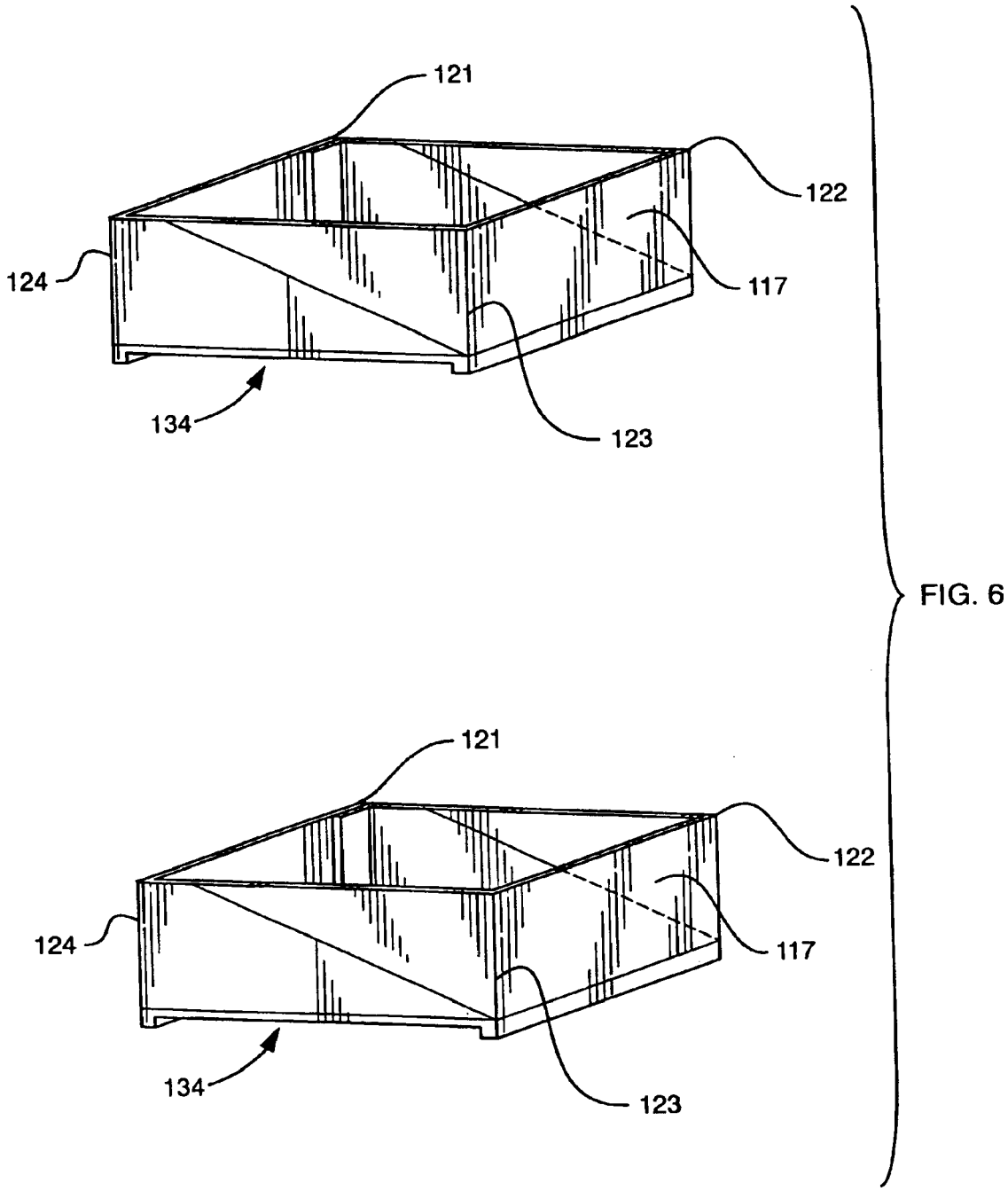
FIG. 6 is a perspective view of the liner elements forming parts of the second embodiment.

The second embodiment differs from the first embodiment in the provision of a second horizontally medially positioned transverse wall extending parallel to the bottom wall with a similar opening, and a corresponding sliding door selectively overlying the opening. With this construction it is possible to discharge only increments of the contents of the container, such increments being discharged as required by considerations of use. In this embodiment, the liner element is formed in two parts, as shown in FIG. 6, to define a recess supporting the second horizontal wall upon the upper edge of the lower part of the liner member.

I wish it to be understood that I do not consider the invention to be limited to the precise details of structure illustrated and described in the specification, for obvious modifications will occur to those skilled in the art to which the invention pertains.

I claim:

1. In a collapsible fibrous container for use in transporting and delivering particulate materials and molded articles, the container having vertical front, rear and side walls, and a bottom wall interconnected with said vertical walls to form a rectangular enclosure; said container having a removable cover with an integral peripheral side wall, and a foldable liner engaging the inner surfaces of said vertical walls, the improvement comprising: said cover being formed of double wall corrugated materials having flutes of varying width for each wall to provide increased rigidity; said liner being formed of corrugated triple wall material, with the corrugations being in mutually congruent relation to provide maximum supporting strength to said container while providing a convenient forming of fold lines.

2. In a collapsible fibrous container for use in transporting and dispensing particulate materials and molded articles, the container having vertical front, rear and side walls, and a bottom wall interconnected with said vertical walls to form a rectangular enclosure, the improvement comprising: said bottom wall having a through opening therein for the passage of contents of said container therethrough, and a slidably mounted generally planar panel selectively overlying said opening for controlling the flow of said contents to said opening; said front wall having a slotted opening for introduction of said panel to overlie said opening in said bottom wall, said panel forming a manually engageable handle projecting outwardly of said front wall; and a foldable liner member positioned inwardly of said rectangular enclosure, said liner member having a recess selectively positionable to overlie said slotted opening.

3. The improvement in accordance with claim 2, including a second foldable liner positioned above said first-mentioned liner to form a peripherally located interstice therebetween; a second bottom wall supported within aid interstice having an opening therein, said front wall having a second slotted opening therein, and a second planar panel overlying said second bottom wall and slidable within said second slotted opening.

* * * * *